US010927720B2

(12) United States Patent
Göransson

(10) Patent No.: US 10,927,720 B2
(45) Date of Patent: Feb. 23, 2021

(54) INTERNAL COMBUSTION ENGINE

(71) Applicant: Scania CV AB, Södertälje (SE)

(72) Inventor: Hans Göransson, Älvsjö (SE)

(73) Assignee: Scania CV AB, Södertälje (SE)

( * ) Notice: Subject to any disclaimer, the term of this patent is extended or adjusted under 35 U.S.C. 154(b) by 0 days.

(21) Appl. No.: 16/307,901

(22) PCT Filed: Jun. 1, 2017

(86) PCT No.: PCT/SE2017/050586

§ 371 (c)(1),
(2) Date: Dec. 6, 2018

(87) PCT Pub. No.: WO2017/217908

PCT Pub. Date: Dec. 21, 2017

(65) Prior Publication Data

US 2019/0186306 A1 Jun. 20, 2019

(30) Foreign Application Priority Data

Jun. 15, 2016 (SE) ..... 1650834-3

(51) Int. Cl.
*F01L 1/344* (2006.01)
*F02D 13/08* (2006.01)
(Continued)

(52) U.S. Cl.
CPC ..... *F01L 1/3442* (2013.01); *F02D 13/08* (2013.01); *F02D 17/04* (2013.01); *F15B 1/24* (2013.01);
(Continued)

(58) Field of Classification Search
CPC ..... F01L 2001/3443; F01L 2001/34446; F01L 2001/34496; F01L 2001/34486;
(Continued)

(56) References Cited

U.S. PATENT DOCUMENTS 4,787,345 A 11/1988 Thoma
5,056,477 A 10/1991 Linder et al.
(Continued)

FOREIGN PATENT DOCUMENTS

CN 102748140 A 10/2012
DE 3930157 A1 3/1991
(Continued)

OTHER PUBLICATIONS

Written Opinion of International Searching Authority for International Patent Application No. PCT/SE2017/050469.
(Continued)

*Primary Examiner* — Devon C Kramer
*Assistant Examiner* — Kelsey L Stanek
(74) *Attorney, Agent, or Firm* — Moore & Van Allen PLLC; W. Kevin Ransom

(57) ABSTRACT

A phase-shifting device, a so-called cam phaser, is arranged between a crankshaft and at least one camshaft to change the at least one camshaft's rotational position in relation to the crankshaft and thus push forward or defer at least one inlet valve's and/or at least one exhaust valve's opening and closing time. The phase-shifting device is connected to an accumulator that can be charged by an oil pump. The oil pressure may be increased with the help of a pressure medium controlled cylinder before or during a phase-shifting process.

15 Claims, 3 Drawing Sheets

(51) Int. Cl.
*F02D 17/04* (2006.01)
*F15B 1/24* (2006.01)
*F01L 1/053* (2006.01)

(52) U.S. Cl.
CPC ..... *F01L 2001/0537* (2013.01); *F01L 2001/3443* (2013.01); *F01L 2001/34446* (2013.01); *F01L 2001/34496* (2013.01); *F01L 2250/02* (2013.01); *F01L 2250/04* (2013.01)

(58) Field of Classification Search
CPC ..... F01L 2250/02; F01L 2001/0537; F01L 2001/34433; F01L 2001/34423; F01L 2001/34426; F01L 1/344; F01L 1/3442; F01L 1/46; F01L 1/465; F01L 2001/3445
USPC ..... 123/90.15, 90.16, 90.17
See application file for complete search history.

(56) References Cited

U.S. PATENT DOCUMENTS

| | | | | |
|---|---|---|---|---|
| 6,234,125 | B1 | 5/2001 | Neubauer et al. | |
| 8,714,123 | B2 | 5/2014 | Rollinger et al. | |
| 9,068,483 | B2 | 6/2015 | Nakamura | |
| 2001/0054411 | A1 | 12/2001 | Yildirim et al. | |
| 2004/0231639 | A1* | 11/2004 | Israel | F02D 13/04 123/321 |
| 2006/0027208 | A1* | 2/2006 | Pinkston | F02D 13/0269 123/316 |
| 2007/0074692 | A1 | 4/2007 | Schafer et al. | |
| 2008/0053389 | A1 | 3/2008 | Schafer et al. | |
| 2008/0251041 | A1 | 10/2008 | Lou | |
| 2010/0326383 | A1* | 12/2010 | Auchter | F01L 1/34 123/90.15 |
| 2011/0271919 | A1 | 11/2011 | Kaneko | |
| 2015/0096511 | A1 | 4/2015 | Hayman et al. | |
| 2016/0108773 | A1* | 4/2016 | Rollinger | F01L 1/34409 123/90.17 |

FOREIGN PATENT DOCUMENTS

| | | | | |
|---|---|---|---|---|
| DE | 102007056684 | A1 | 5/2009 | |
| DE | 102008001802 | A1 | 11/2009 | |
| DE | 102012009668 | B3 * | 8/2013 | F15B 21/14 |
| DE | 102012009668 | B3 | 8/2013 | |
| DE | 102013207616 | A1 | 10/2014 | |
| JP | 11153014 | A * | 6/1999 | F01L 1/34 |
| JP | H11153014 | A | 6/1999 | |
| WO | WO2006127347 | A1 | 11/2006 | |
| WO | WO2014173399 | A1 | 10/2014 | |

OTHER PUBLICATIONS

International Search Report for International Patent Application No. PCT/SE2017/050469 dated Aug. 15, 2017.
Swedish Office Action for Swedish Patent Application No. 1650792-3 dated Dec. 27, 2016.
SCANIA CV AB, International Application No. PCT/SE2017/050586, International Search Report, dated Aug. 25, 2017.
SCANIA CV AB, International Application No. PCT/SE2017/050586, Written Opinion, dated Aug. 25, 2017.
SCANIA CV AB, International Application No. PCT/SE2017/050586, International Preliminary Report on Patentability, dated Dec. 18, 2018.
SCANIA CV AB, Swedish Application No. 1650834-3, Office Action, dated Dec. 27, 2016.
SCANIA CV AB, European Application No. 178136875, Extended European Search Report, dated Nov. 15, 2019.
SCANIA CV AB, Chinese Application No. 201780037335.2, Office Action, dated Jun. 16, 2020.

* cited by examiner

INTERNAL COMBUSTION ENGINE

CROSS-REFERENCE TO RELATED APPLICATIONS

This application is a national stage application (filed under 35 § U.S.C. 371) of PCT/SE2017/050586, filed Jun. 1, 2017 of the same title, which, in turn, claims priority to Swedish Application No. 1650834-3 filed Jun. 15, 2016; the contents of each of which are hereby incorporated by reference.

FIELD OF THE INVENTION

The present invention relates to a combustion engine and a vehicle comprising a combustion engine comprising at least one phase-shifting device.

BACKGROUND OF THE INVENTION

Cam phasers may be used in combustion engines to change the rotational positions of camshafts in relation to each other and in relation to a crankshaft in order to phase-shift, i.e., to push forward or delay the opening and closing times of inlet valves and exhaust valves. By using cam phasers, the engine's performance, among others, may be improved, fuel consumption may be reduced, the engine braking performance may be improved and improved control of emissions may be obtained. The improved control of emissions may in turn make it possible to eliminate EGR-systems used in exhaust purification.

U.S. Pat. No. 8,714,123 B2 shows that phase-shifting may be achieved with the help of hydraulic cam phasers operated by pressurized oil in the engine oil system. A cam phaser may be arranged at each camshaft and supplied with oil with the help of the engine's oil pump to change the rotational positions of the camshafts in relation to each other and in relation to a crankshaft, to phase-shift the opening and dosing times of the valves. It is important that the oil pressure in the oil system is sufficiently high for a quick and robust phase-shifting function to be obtained. To ensure a higher oil pressure than otherwise, it is prior art to, when the engine is in operation, add oil to an accumulator tank in which the oil pressure may be increased with the help of a spring-loaded piston or similar, and to add the pressurized oil to a cam phaser during a phase-shifting process, at least on the occasions where the oil pressure achieved by the oil pump is not sufficiently high. It may be desirable to decrease the oil pressure in the engine to be able to use a smaller oil pump than otherwise. The purpose of such a measure may be to reduce parasitic losses in the engine and to reduce fuel consumption. In some operating modes, e.g. when a vehicle is driven with a low engine speed or at a transition from idling to operation with a higher engine load, there may be a risk that the oil pressure is too low for a quick and robust phase-shifting function to be obtained, even though the pressurized oil in the accumulator tank is used.

SUMMARY OF THE INVENTION

One objective of the present invention is to increase the speed and robustness in a phase-shifting function when hydraulic cam phasers are used. These and other purposes are achieved through the features described in the claims below. Through the use of the invention, a very fast and robust regulation of the cam phaser is achieved, with a high pressure providing very good restraining load against variable camshaft speeds. Since the pressure is very high, the oil pressure in the engine may be reduced and a smaller oil pump than otherwise may be used, reducing parasitic losses in the engine and thus also fuel consumption.

Other features and advantages of the invention are set out in the claims, the description of the example embodiment and the enclosed drawings.

BRIEF DESCRIPTION OF THE DRAWINGS

Below is a description, by way of example, of preferred embodiments of the invention with reference to the enclosed drawings, in which.

DETAILED DESCRIPTION OF THE INVENTION

Figure 1:
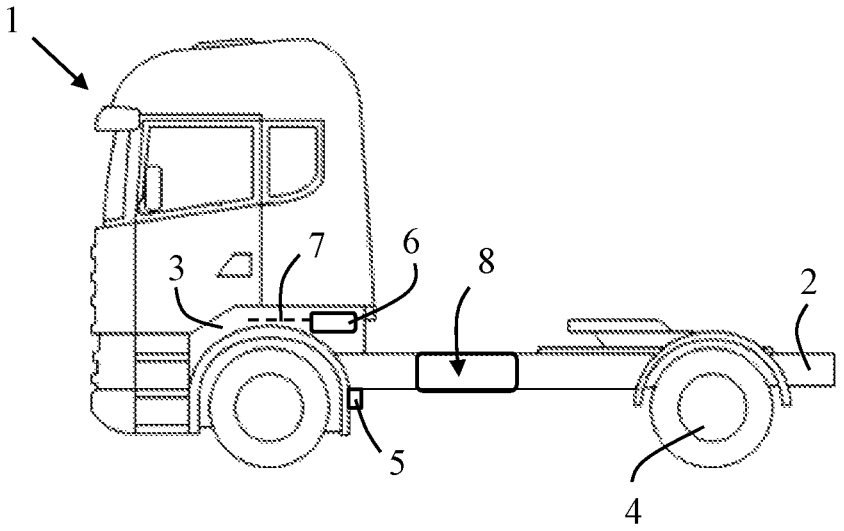
FIG. 1 shows a vehicle with a combustion engine according to the present invention.

FIG. 1 shows a motor vehicle 1 with a vehicle frame 2 at which a combustion engine 3 is arranged to operate at least two driving wheels 4. An oil pan 5 is arranged at a lower section of the combustion engine 3 and adapted to constitute a collection container for oil after it has circulated through oil channels in the combustion engine's 3 lubricating system 7 to cool and lubricate the engine 3 during operation. An oil pump 6 is arranged at the combustion engine 3 to pump oil through the oil channels. A pneumatic brake system 8 is arranged at the vehicle frame 2 to brake the wheels of the vehicle. The motor vehicle 1 may be a heavy goods vehicle, e.g. a truck or a bus or a lighter vehicle, e.g. a passenger car. The combustion engine 3 may be a four-stroke engine and e.g. a diesel engine or an otto engine. In case of alternative embodiments, the combustion engine 3 may be intended for industrial or marine use.

Figure 2:
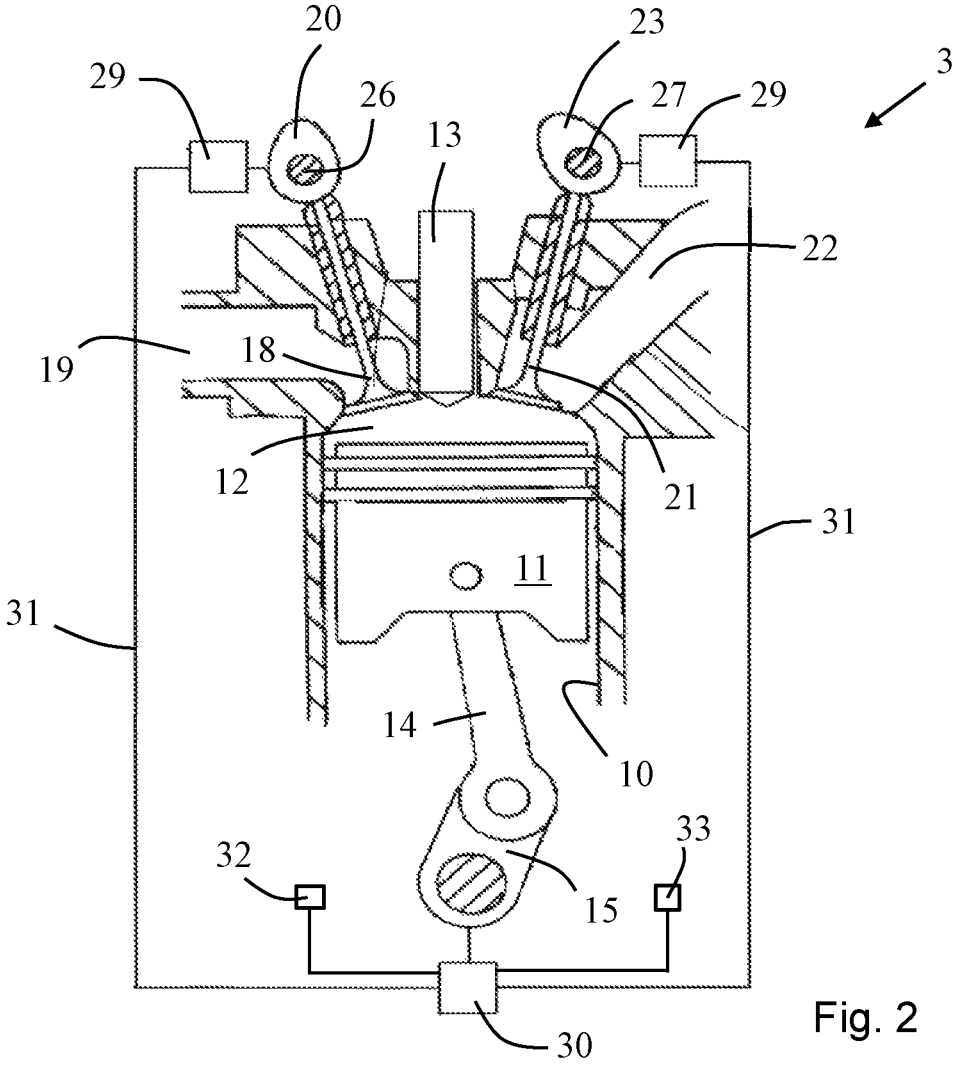
FIG. 2 is a cross-sectional view of a schematically displayed combustion according to the present invention.

FIG. 2 shows a combustion engine 3 with at least one cylinder 10, with a piston 11 arranged in each cylinder 10. The piston 11 demarcates a combustion chamber 12, which is adapted to be supplied with fuel via a fuel injector 13. The piston 11 is connected via a connecting rod 14 to a crankshaft 15, which at rotation moves the piston 11 forwards and backwards in the cylinder 10. At least one inlet valve 18 is arranged in each cylinder 10. The inlet valve 18 is connected to an inlet system 19 and is adapted to control the supply of air to the combustion chamber 12. At least one first camshaft 20 controls the opening and closing times of each inlet valve 18 in relation to the position of the crankshaft 15 and the piston 11. At least one exhaust valve 21 is arranged in each cylinder 10. The exhaust valve 21 is connected to an exhaust system 22 and is adapted to control the evacuation of exhausts from the combustion chamber 12. At least one second camshaft 23 controls the opening and closing times of each inlet valve 21 in relation to the position of the crankshaft 15 and the piston 11. In an alternative embodiment, at least one camshaft (20, 23) may be used to control the at least one inlet valve (18) and/or the at least one exhaust valve (21). Preferably, two inlet valves 18 and two exhaust valves 21 are arranged in each cylinder 10. Depending on the type of combustion engine 3, two first and two second camshafts 20, 23 may be arranged in the combustion engine 3, which is advantageous if the combustion engine 3 is a so-called V-engine. Preferably, the combustion engine 3 has several cylinders 10, e.g. four, six or eight.

Every camshaft 20, 23 is controlled by and rotatably connected with the crankshaft 15 via a conventional transmission device and is adapted to rotate around a rotational shaft 26, 27 with a speed related to the combustion engine's 3 speed to open and close the respective valve 18, 21. At least one hydraulic phase-shifting device 29, a so-called cam phaser, is arranged between the crankshaft 15 and at least one of the camshafts 20, 23 to change the rotational position of the at least one camshaft 20, 23 in relation to the crankshaft 15, in order thus to push forward or defer the at least one inlet valve's 18 and/or the at least one exhaust valve's 21 opening and closing times. The phase-shifting device 29 may be adapted so that the camshaft 20, 23 may be shifted within an interval in the range of 50-100 crankshaft degrees, but preferably approx. 70 crankshaft degrees, and preferably a phase-shifting device 29 is arranged at each camshaft 20,23.

Figure 3:
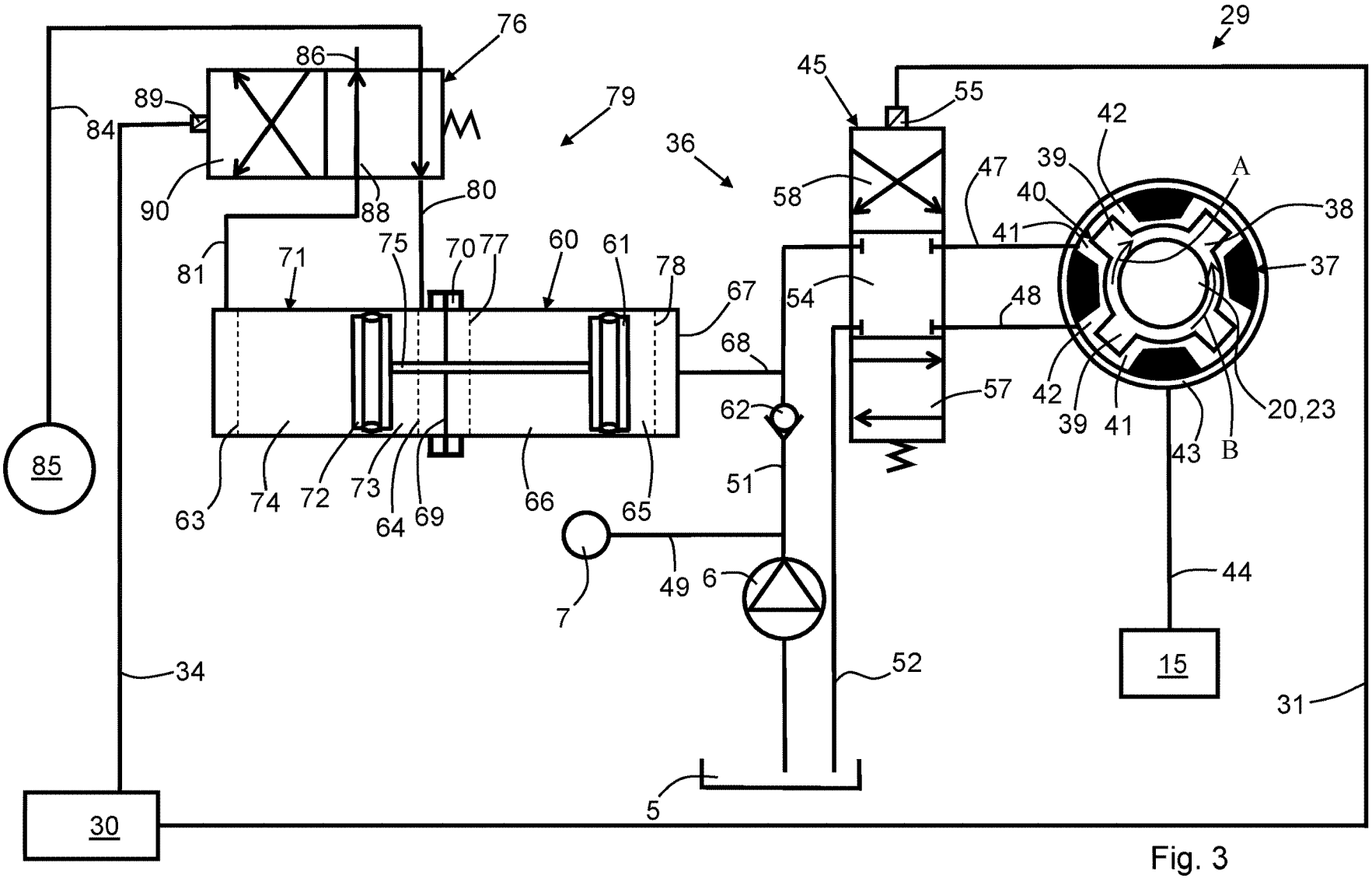
FIG. 3 shows a schematic display of a hydraulic cam phaser and a control system for the same, according to a first embodiment of the present invention.

A control device 30 is connected to each phase-shifting device 29 via at least one conduit 31, and adapted to control the activation of the phase-shifting device 29 with the help of information regarding one or several parameters related to the operation of the combustion engine 3. The control device 30 may be adapted to receive information from sensors 32 and/or from other control devices 33 regarding e.g. the combustion engine's 3 load and engine speed, absolute pressure in the inlet system 19, the temperature of the inlet air, the mass-air flow, exhaust gas temperature, gas control mode and the selected gear in the vehicle's gearbox. FIG. 3 shows, in a very simplified manner, a phase-shifting device 29 with a hydraulic control system 36. The phase-shifting device 29 may comprise a house 37 into which one end of a camshaft 20, 23 extends. The camshaft 20, 23 is fixedly connected with a rotor 38 with a number of radially outward oriented teeth 39, each of which extends into a space 40 in the house 37, demarcating a first chamber 41 and a second chamber 42. All the first chambers 41 are connected to each other via non-displayed channels and all second chambers 42 are connected to each other via channels that are also not displayed. A driving wheel 43, e.g. a toothed wheel, is fixedly connected with the house 37 and mechanically connected to the crankshaft 15 via a transmission device 44, e.g. a cogwheel transmission, a chain transmission or a belt transmission, so that the camshaft 20, 23 and the house 37 rotate with the same speed and preferably half as fast as the crank shaft 15 when the combustion engine 3 is in operation. The first chamber 41 is connected to a directional valve 45 via a first hydraulic conduit 47 and the second chamber 42 is connected to the directional valve 45 via a second hydraulic conduit 48. The directional valve 45 is connected, via an inlet conduit 51 at which the oil pump 6 is arranged, to the oil pan 5, to which a return conduit 52 from the directional valve 45 also leads. A third hydraulic conduit 49 is connected to the inlet conduit 51 between the oil pump 6 and the directional valve 45 to lead oil to the combustion engine's 3 lubricating system 7.

When the directional valve 45 assumes an interim position 54, which may be a resting position, all of its inlet and outlet conduits 47, 48, 51, 52 are blocked. Under the influence of a solenoid 55 that may be controlled by programmed instructions in the control device 30 via a control conduit 31, the directional valve 45 may be made to assume one of the first or a second position 57, 58, in which the inlet conduit 51 is connected to one of the chambers 41, 42, at the same time as the second chamber 41, 42 is connected to the return conduit 52. When the first chamber 41 at the first position 57 of the directional valve is supplied with oil with the help of the oil pump 6, at the same time as oil in the second chamber 42 is returned to the oil pan 5 via the return conduit 52, the camshaft 20, 23 is turned in a first direction A in relation to the house 37, pushing forward the opening and closing times of the valves 18, 19. When the second chamber 42 at the second position 58 of the directional valve is supplied with oil with the help of the oil pump 6, at the same time as oil in the first chamber 41 is returned to the oil pan 5 via the return conduit 52, the camshaft 20, 23 is turned in a second direction B in relation to the house 37, deferring the opening and closing times of the valves 18, 19. In an alternative embodiment, the opening times of the valves 18, 19 may be deferred when the camshaft 20, 23 is turned in the first direction A and pushed forward when the camshaft 20, 23 is turned in the second direction B. The actuating speed, i.e. the speed with which the respective camshaft 20, 23 may be turned from one position to another may depend on the oil pressure in the lubricating system 7, which oil pressure may be around 1.5-4 bar. To obtain a higher actuating speed, even if the pressure in the lubricating system 7 is relatively low, the phase-shifting device 29 may be connected to an accumulator 60, which can be charged by the oil pump 6, and in which the oil pressure may be increased with the help of a pressure media controlled cylinder 71 before or during the phase-shifting process. The accumulator 60 may consist of a cylinder, at whose end wall 67 one end of a fourth hydraulic conduit 68 is connected, whose second end is connected to the inlet conduit 51 in a position after the oil pump 6, between a non-return valve 62 and the directional valve 45, to transport oil from the oil pan 5 to the accumulator 60. The non-return valve 62 may be used to ensure that no oil in the accumulator 60 flows back to the oil pan 5 or is supplied to the lubricating system 7 during a phase-shifting process and/or when the oil pressure in the combustion engine is lower than the oil pressure in the accumulator 60.

In the accumulator 60, a moveable first piston 61 is arranged between two end positions 77, 78, demarcating a first chamber 65 which is connected with the inlet conduit 51 via the fourth hydraulic conduit 68, through which oil may be added to the first chamber 65 and which allows the accumulator 60 to assume a first state at which the first chamber 65 contains oil, and a second state at which at least a part of the oil contained has been supplied to the phase-shifting device 29. The first piston 61 is connected to the pressure media controlled cylinder 71, which is adapted to impact the first piston 61 so that it assumes its end positions 77, 78, which end positions 77, 78 correspond to the accumulators 60 first and second states, respectively. The control device 30 is thus adapted to control the activation of the pressure medium controlled cylinder 71 with the help of information regarding one or several parameters relating to the operation of the combustion engine 3. The first piston 61 also demarcates a second chamber 66 that may be bled via a non-displayed channel that may extend between the second chamber 66 and the surrounding atmosphere.

At the accumulators 60 second end wall 69, a flange 70 may be arranged, at which the pressure medium controlled cylinder 71 may be fitted. The pressure medium controlled cylinder 71 may be a double-acting cylinder and may comprise a second piston 72, movable between two end positions 63, 64, demarcating a first and a second chamber 73, 74 in the cylinder. The second piston 72 is connected to a piston rod 75 extending into the accumulator 60 and being directly connected with the first piston 61. The first chamber 73 is connected to a directional valve 76 in a control system 79, e.g. a pneumatic control system, via a first pressure medium conduit 80 and the second chamber 74 is connected to the directional valve 76 via a second pressure medium valve 81. The directional valve 76, which may be switched between a first position 88 and a second position 90, is connected to a pressure medium source 85 via an inlet conduit 84 and is connected to the surrounding atmosphere, via an outlet conduit 86. The pressure medium source 85 may be a pressurized air source and the pressure medium controlled cylinder 71 may be a pressurized air cylinder that may be connected to the pneumatic brake system 8 in the vehicle (FIG. 1) in which the air pressure may be 7-12 bar. Instead of using pressurized air as an operative medium, other pressure mediums may obviously be used, such as oil in vehicle fitted hydraulic systems, which oil has a pressure that is higher than the pressure in the engine's lubricating system. One example of such a system is the control system, in whose power steering servo pump the pressure may be 100-170 bar.

When the directional valve 76 assumes the first position 88, which may be a resting position 88, the inlet conduit 84 is connected to the first chamber 73, at the same time as the second chamber 74 is connected to the atmosphere via the outlet conduit 86. Under the influence of a solenoid 89 that may be controlled by programmed instructions in the control device 30 via a control conduit 34, the directional valve 76 may be made to assume a second position 90, in which the inlet conduit 84 is connected to the second chamber 74, at the same time as the first chamber 73 is connected to the atmosphere via the outlet conduit 86. When the pressure medium controlled cylinder's 71 first chamber 73 is supplied with pressurized medium pressurized medium source 85 via the inlet conduit 84, at the directional valve's 76 first position 88, and the first pressure medium conduit 80 is evacuated, simultaneously with the pressure medium in the pressure medium controlled cylinder's 71 second chamber 74 being evacuated via the second pressure medium conduit 81 and the outlet conduit 86, the pressure medium impacts the pressure medium cylinder's 71 second piston 72 in such a manner that it assumes one end positions 63, which also means that the accumulator's 60 first piston 61 is shifted toward one end position 77, corresponding to the accumulator's 60 first state. The first chamber 65 to the right of the accumulator's 60 first piston 61 is filled with oil and is therefore in an oil-filled state. When a sensor 32 and/or a control device 33 (FIG. 2) in the vehicle detects one or several relevant parameters relating to the operation of the combustion engine, they emit a signal to the control device 30, which indicates a phase-shifting activation. The control device 30 then emits an out-signal via the conduit 31 to the phase-shifting device's 29 directional valve 45, to assume its first or its second position 57, 58 and an out-signal via the conduit 34 to the directional valve 76, to assume its second position 90. The pressure medium from the pressure medium source 85 will now be led to the pressure medium controlled cylinder's 71 second chamber 74, at the same time as its first chamber 73 is bled, which results in the pressure medium impacting the pressure medium cylinder's 71 second piston 72 to assume its second end position 64. The second piston 72 thus directly impacts the first piston 61 in the accumulator 60, which first piston is shifted toward its second end position 78 corresponding to the accumulator's 60 second state, wherein substantially all or at last a part of the oil housed in the accumulator's 60 first chamber 65 is led to the directional valve 45 and the phase-shifting device 29, via the fourth hydraulic conduit 68 and the inlet conduit 51, with a pressure corresponding to the pressure in the pressure medium impacting the second piston 72. Since this pressure is substantially higher than the oil pressure that the oil pump 6 may generate, the phase-shifting of the opening and closing times of the valves 18, 21 (FIG. 2) will take place significantly faster than if oil was supplied to the phase-shifting device 29 with pressure generated by the oil pump 6. After the phase-shifting has been carried out, the sensor 32 and/or the control device 33 (FIG. 2) will no longer emit any signal indicating a phase-shift activation. The positional valves 76, 45 will therefore no longer obtain any activation signal from the control device 30 and accordingly will revert to their first position 88 and their interim position 54, respectively, resulting in the second chamber 74 in the pressure medium controlled cylinder 71 being bled, at the same time as the first chamber 73 is supplied with pressure medium impacting the second piston 72 to assume one end position 63, which also means that the first piston 61 of the accumulator 60 is shifted toward one end positions 77, at the same time as the first chamber 65 in the accumulator 60 is supplied with oil from the oil sump 5 with the help of the oil pump 6.

Figure 4:
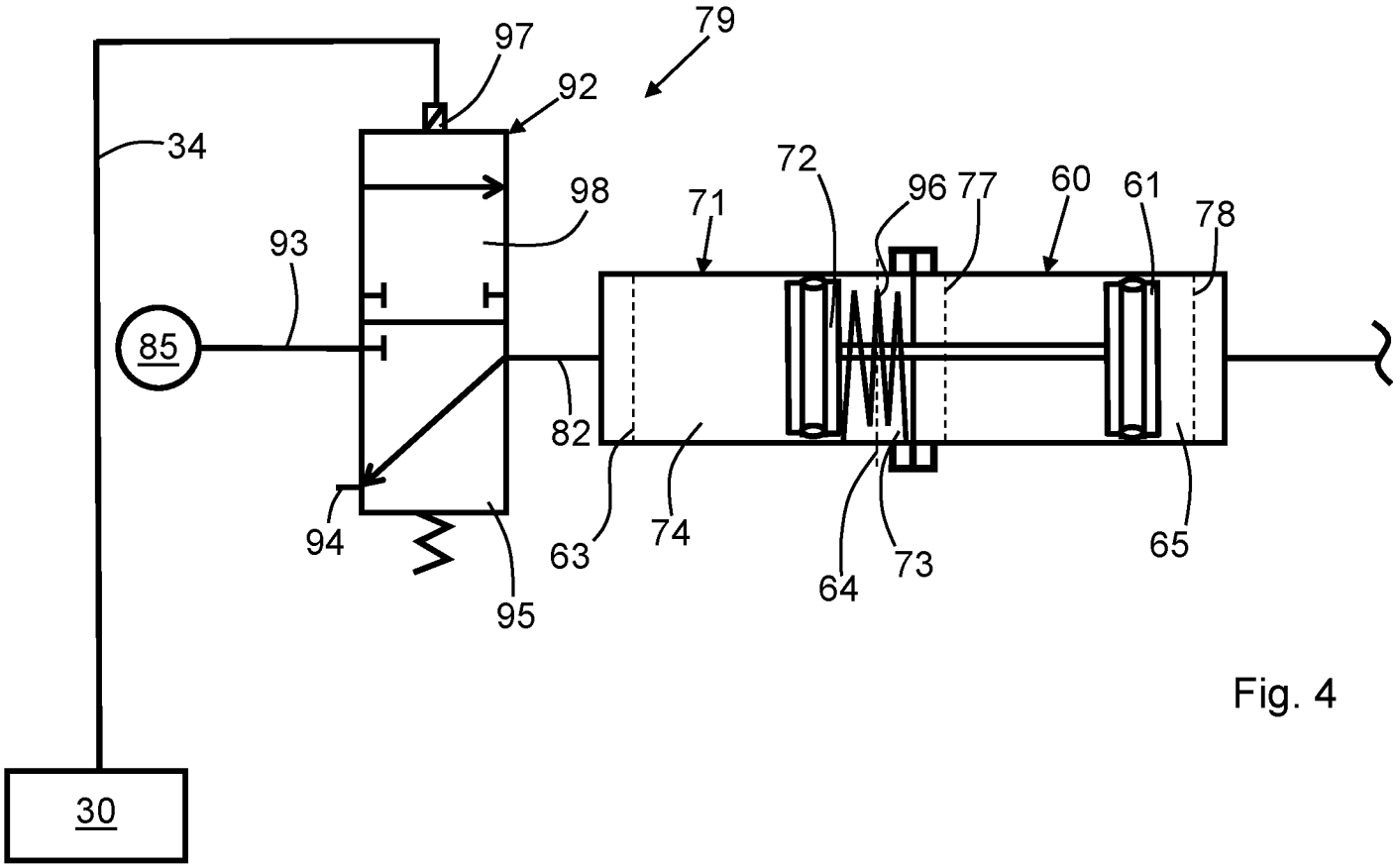
FIG. 4 shows a schematic display of a hydraulic cam phaser and a control system for the same, according to a second embodiment of the present invention.

FIG. 4 shows an alternative embodiment, where the pressure medium controlled cylinder 71 is a single-acting cylinder instead of a double-acting cylinder. The pressure medium controlled cylinder's 71 second chamber 74 is connected to a directional valve 92 in the control system 79 via a third pressure medium conduit 82. The directional valve 92, which may be switched between a first position 95 and a second position 98, is connected with the pressure medium source 85 via an inlet conduit 93, and connected with the surrounding atmosphere via an outlet conduit 94. The first chamber 73 may be bled via a non-displayed channel extending between the first chamber 73 and the surrounding atmosphere. A spring element 96, such as a compression spring, is arranged in the first chamber 73. One of the ends of the spring element 96 may be adapted to abut against the second piston's 72 end surface, and its second end may be adapted to abut against an end wall facing the accumulator 60 in the pressure medium controlled cylinder 71.

When the directional valve 92 assumes the first position 95, which may be a resting position, the inlet conduit 93 is blocked at the same time as the outlet conduit 94 is open, wherein the spring element 96 impacts the second piston 72 to assume one end positions 63, which also means that the accumulator's 60 first piston 61 is shifted towards one end positions 77, corresponding to the accumulator's first state. Under the influence of a solenoid 97 that may be controlled by programmed instructions in the control device 30 via a control conduit 34, the directional valve 92 may be made to assume a second position 98, in which the inlet conduit 93 is connected to the second chamber 74. The pressure medium from the pressure medium source 85 will now be led to the pressure medium controlled cylinder's 71 second chamber 74, at the same time as its first chamber 73 is bled, which results in the pressure medium impacting the pressure medium cylinder's 71 second piston 72 to compress the spring element 96 and assume its second end position 64. The second piston 72 thus directly impacts the first piston 61 in the accumulator 60, which first piston is shifted toward its second end position 78 corresponding to the accumulator's 60 second state, wherein substantially all or at least a part of the oil housed in the accumulator's 60 first chamber 65 is led to the directional valve 45 and the phase-shifting device 29. Once the phase-shift has been completed, the positional valve 92 will therefore no longer obtain any activation signal from the control device 30 and accordingly will revert to its first position 95, resulting in the second chamber 74 in the pressure medium controlled cylinder 71 being bled, at the same time as the second piston 72 is pressed against one end positions 63 with the help of the spring element 96, which also means that the first piston 61 in the accumulator 60 is shifted towards one end position 77, at the same time as the first chamber 65 in the accumulator 60 is supplied with oil from the oil sump 5 with the help of the oil pump 6. The invention is not limited to the embodiments described above, but numerous possible modifications thereof are obvious to a person skilled in the area, without such person departing from the spirit of the invention as defined by the claims.

In the described embodiments, directional valves 45, 76, 92 are used, which may be set into various states, one of which states 54, 88, 95 is described as a resting state. In alternative embodiments, and depending on the current application, any state may be selected as the resting state. The description shows a directional valve 45 controlled electrically in two directions and directional valves 76, 92 controlled electrically in one direction and with a return spring in another direction. In alternative embodiments, the directional valve 45 may be controlled electrically in one direction and with a return spring in one direction, and likewise the valves 76, 92 maybe controlled electrically in two directions.

The invention claimed is:

1. A combustion engine comprising:

at least one combustion cylinder;

at least one inlet valve arranged in each combustion cylinder;

at least one exhaust valve arranged in each combustion cylinder;

at least one camshaft controlling the at least one inlet valve and/or the at least one exhaust valve;

one crankshaft controlling the at least one camshaft;

at least one hydraulic phase-shifting device arranged between the crankshaft and the at least one camshaft to change a rotational position of the at least one camshaft in relation to the crankshaft to thereby push forward or defer opening and closing times of the at least one inlet valve and/or the at least one exhaust valve; and an accumulator connected to said at least one hydraulic phase-shifting device, said accumulator comprising:

a first piston configured to move between two end positions;

a first chamber connected to an inlet conduit through which oil is supplied to the first chamber of the accumulator and which allows the accumulator to assume a first state at which the first chamber of the accumulator contains oil, and a second state at which at least a part of the contained oil has been supplied to said at least one hydraulic phase-shifting device; and a pressure-medium controlled cylinder connected to the first piston, said pressure-medium controlled cylinder configured to impact the first piston to selectively move the piston to the two end positions of the piston, which two end positions correspond to the first and second states of the accumulator, respectively, wherein the pressure-medium controlled cylinder comprises a second piston configured to move between two end positions demarcating a first and a second chamber in the pressure-medium controlled cylinder and the second piston is connected to a piston rod that extends into the accumulator and is connected to the first piston, wherein the second chamber of the pressure-medium controlled cylinder is connected with a directional valve via a third pressure-medium conduit, wherein the first chamber of the pressure-medium controlled cylinder contains at least one spring element and the directional valve is connected with a pressure medium source via a third inlet conduit, wherein the directional valve is configured to be switched between a second position to supply pressure-medium to the second chamber of the pressure-medium controlled cylinder and shift the first piston towards the end position of the first piston corresponding to a second state of the accumulator, and a first position where the spring element is adapted to shift the first piston towards the end position of the first piston corresponding to the first state of the accumulator.

2. The combustion engine according to claim 1, further comprising a control unit configured to control activation of the pressure-medium controlled cylinder based on one or more operation parameters of the combustion engine.

3. A combustion engine according to claim 1, wherein the pressure medium controlled cylinder is a pneumatic cylinder.

4. The combustion engine according to claim 3, wherein the pneumatic cylinder is connected to a pneumatic brake system.

5. The combustion engine according to claim 1, wherein each combustion cylinder comprises two inlet valves and two exhaust valves.

6. The combustion engine according to claim 1, wherein the at least one camshaft of the combustion engine comprises at least one first camshaft controlling each inlet valve and at least one second camshaft controlling each exhaust valve.

7. The combustion engine according to claim 1, wherein the at least one camshaft of the combustion engine comprises two first and two second camshafts arranged in the combustion engine.

8. The combustion engine according to claim 1, wherein the combustion engine is a diesel engine.

9. The combustion engine according to claim 1, wherein the at least one hydraulic phase-shifting device is configured to shift the at least one camshaft within an interval of 60-100 crankshaft degrees.

10. The combustion engine according to claim 1, wherein the at least on hydraulic phase-shifting device is configured to shift the at least one camshaft 70 crankshaft degrees.

11. A combustion engine comprising:

at least one combustion cylinder;

at least one inlet valve arranged in each combustion cylinder;

at least one exhaust valve arranged in each combustion cylinder;

at least one camshaft controlling the at least one inlet valve and/or the at least one exhaust valve;

one crankshaft controlling the at least one camshaft;

at least one hydraulic phase-shifting device arranged between the crankshaft and the at least one camshaft to change a rotational position of the at least one camshaft in relation to the crankshaft to thereby push forward or defer opening and closing times of the at least one inlet valve and/or the at least one exhaust valve; and an accumulator connected to said at least one hydraulic phase-shifting device, said accumulator comprising:

a first piston configured to move between two end positions;

a first chamber connected to an inlet conduit through which oil is supplied to the first chamber of the accumulator and which allows the accumulator to assume a first state at which the first chamber of the accumulator contains oil, and a second state at which at least a part of the contained oil has been supplied to said at least one hydraulic phase-shifting device; and a pressure-medium controlled cylinder connected to the first piston, said pressure-medium controlled cylinder configured to impact the first piston to selectively move the piston to the two end positions of the piston, which two end positions correspond to the first and second states of the accumulator, respectively, wherein the pressure-medium controlled cylinder comprises a second piston configured to move between two end positions demarcating a first and a second chamber in the pressure-medium controlled cylinder and the second piston is connected to a piston rod that extends into the accumulator and is connected to the first piston, wherein the first chamber of the pressure-medium controlled cylinder is connected with a directional valve via a first pressure medium conduit, wherein the second chamber of the pressure-medium controlled cylinder is connected with the directional valve via a second pressure-medium conduit and the directional valve is connected with a pressure-medium source via a second inlet conduit, wherein the directional valve is configured to be switched between a first position to supply pressure-medium to the first chamber of the pressure-medium controlled cylinder and shift the first piston towards the end position of the first piston corresponding to the first state of the accumulator, and a second position to supply pressure medium to the second chamber of the pressure-medium controlled cylinder and shift the first piston towards the end position of the first piston corresponding to the second state of the accumulator.

12. A vehicle comprising a combustion engine, wherein said combustion engine comprises:

at least one combustion cylinder;

at least one inlet valve arranged in each combustion cylinder;

at least one exhaust valve arranged in each combustion cylinder;

at least one camshaft controlling the at least one inlet valve and/or the at least one exhaust valve;

one crankshaft controlling the at least one camshaft;

at least one hydraulic phase-shifting device arranged between the crankshaft and the at least one camshaft to change a rotational position of the at least one camshaft in relation to the crankshaft to thereby push forward or defer opening and closing times of the at least one inlet valve and/or the at least one exhaust valve; and an accumulator connected to said at least one hydraulic phase-shifting device, said accumulator comprising:

a first piston configured to move between two end positions;

a first chamber connected to an inlet conduit through which oil is supplied to the first chamber of the accumulator and which allows the accumulator to assume a first state at which the first chamber of the accumulator contains oil, and a second state at which at least a part of the contained oil has been supplied to said at least one hydraulic phase-shifting device; and a pressure-medium controlled cylinder connected to the first piston, said pressure-medium controlled cylinder configured to impact the first piston to selectively move the piston to the two end positions of the piston, which two end positions correspond to the first and second states of the accumulator, respectively, wherein the pressure-medium controlled cylinder comprises a second piston configured to move between two end positions demarcating a first and a second chamber in the pressure-medium controlled cylinder and the second piston is connected to a piston rod that extends into the accumulator and is connected to the first piston, wherein the second chamber of the pressure-medium controlled cylinder is connected with a directional valve via a third pressure-medium conduit, wherein the first chamber of the pressure-medium controlled cylinder contains at least one spring element and the directional valve is connected with a pressure medium source via a third inlet conduit, wherein the directional valve is configured to be switched between a second position to supply pressure-medium to the second chamber of the pressure-medium controlled cylinder and shift the first piston towards the end position of the first piston corresponding to a second state of the accumulator, and a first position where the spring element is adapted to shift the first piston towards the end position of the first piston corresponding to the first state of the accumulator.

13. The vehicle according to claim 12, further comprising a control unit configured to control activation of the pressure-medium controlled cylinder based on one or more operation parameters of the combustion engine.

14. The vehicle according to claim 12, wherein the pressure medium controlled cylinder is a pneumatic cylinder.

15. A vehicle comprising a combustion engine, wherein said combustion engine comprises:

at least one combustion cylinder;

at least one inlet valve arranged in each combustion cylinder;

at least one exhaust valve arranged in each combustion cylinder;

at least one camshaft controlling the at least one inlet valve and/or the at least one exhaust valve;

one crankshaft controlling the at least one camshaft;

at least one hydraulic phase-shifting device arranged between the crankshaft and the at least one camshaft to change a rotational position of the at least one camshaft in relation to the crankshaft to thereby push forward or defer opening and closing times of the at least one inlet valve and/or the at least one exhaust valve; and an accumulator connected to said at least one hydraulic phase-shifting device, said accumulator comprising:

a first piston configured to move between two end positions;

a first chamber connected to an inlet conduit through which oil is supplied to the first chamber of the accumulator and which allows the accumulator to assume a first state at which the first chamber of the accumulator contains oil, and a second state at which at least a part of the contained oil has been supplied to said at least one hydraulic phase-shifting device; and a pressure-medium controlled cylinder connected to the first piston, said pressure-medium controlled cylinder configured to impact the first piston to selectively move the piston to the two end positions of the piston, which two end positions correspond to the first and second states of the accumulator, respectively, wherein the pressure-medium controlled cylinder comprises a second piston configured to move between two end positions demarcating a first and a second chamber in the pressure-medium controlled cylinder and the second piston is connected to a piston rod that extends into the accumulator and is connected to the first piston, wherein the first chamber of the pressure-medium controlled cylinder is connected with a directional valve via a first pressure medium conduit, wherein the second chamber of the pressure-medium controlled cylinder is connected with the directional valve via a second pressure-medium conduit and the directional valve is connected with a pressure-medium source via a second inlet conduit, wherein the directional valve is configured to be switched between a first position to supply pressure-medium to the first chamber of the pressure-medium controlled cylinder and shift the first piston towards the end position of the first piston corresponding to the first state of the accumulator, and a second position to supply pressure medium to the second chamber of the pressure-medium controlled cylinder and shift the first piston towards the end position of the first piston corresponding to the second state of the accumulator.

* * * * *